US006164906A

United States Patent [19]

Norberg et al.

[11] Patent Number: 6,164,906

[45] Date of Patent: Dec. 26, 2000

[54] REGULATING VALVE FOR ENGINES OPERATED BY A MEDIUM UNDER PRESSURE

[75] Inventors: Lars Norberg, Gothenburg; Hans Aiderborn, Stenungsund, both of Sweden

[73] Assignee: Adevus Teknik AB, Sweden

[21] Appl. No.: 09/214,965

[22] PCT Filed: Jul. 15, 1997

[86] PCT No.: PCT/SE97/01279

§ 371 Date: Sep. 21, 1999

§ 102(e) Date: Sep. 21, 1999

[87] PCT Pub. No.: WO98/02642

PCT Pub. Date: Jan. 22, 1998

[30] Foreign Application Priority Data

Jul. 15, 1996 [SE] Sweden ..... 9602771

[51] Int. Cl.[7] ..... F01B 25/02

[52] U.S. Cl. ..... 415/147; 251/44

[58] Field of Search ..... 415/147; 60/370, 60/409, 410, 411; 251/33, 44, 333; 91/46 P, DIG. 3

[56] References Cited

U.S. PATENT DOCUMENTS 3,905,393 9/1975 Hartwig ..... 251/333
5,848,779 12/1998 Murbe et al. ..... 91/468

FOREIGN PATENT DOCUMENTS

0575301A1 12/1993 European Pat. Off. .

*Primary Examiner*—Edward K. Look
*Assistant Examiner*—Hermes Rodriguez
*Attorney, Agent, or Firm*—Samuels, Gauthier & Stevens

[57] ABSTRACT

A regulating valve for engines operated by a medium under pressure, in particular compressed air operated engines, in order to regulate the flow of compressed air to the engine to provide a substantially constant revolution rate at varying load, the regulating valve being provided with a valve body for controlling the momentary volume flow through the regulating valve.

3 Claims, 1 Drawing Sheet

REGULATING VALVE FOR ENGINES OPERATED BY A MEDIUM UNDER PRESSURE

TECHNICAL FIELD

The invention relates to a regulating valve for engines operated by a medium under pressure, in particular compressed air operated engines, in order to regulate the flow of compressed air to the engine to provide a substantially constant revolution rate at varying load, the regulating valve being provided with a valve body for controlling the momentary volume flow through the regulating valve.

BACKGROUND OF THE INVENTION

Compressed air operated engines arc used in a number of applications. Primarily it is herein related to engines of displacement type, such as lamella engines having a wing provided rotor, but the invention can also be applied to turbine engines. In certain applications such engines operate using a shifting torque load. This is for example the case at hand tools such as a angle grinder, other grinding machines, and brushing tools as well as drilling machines. See for example the grinding machine according to U.S. Pat. No. 3,767,332 (Wickham et al).

By means an adjustable air valve the addition of air from the compressed air system is adjusted to the machine in such a way that a desired rotation speed is obtained, herein called the idling rotation speed. If no further means for regulating the rotation speed is at hand, the rotation speed will decrease at the adding of a load to the engine proportional to the torque added.

This is generally not wanted but one wants to maintain a substantially constant rotation speed regardless of the torque load. It is hereby known to arrange rotation speed regulating means of the centrifugal type, cf. the above mentioned patent publication. In these the throttling of ingoing air is adjusted dependent upon the position of rotating weights in the regulating means so that a decreasing rotation speed can be counteracted as the position of the weights is allowed to determine the throttling of the air added. Such a rotation speed regulating means will, however, become complicated and has not found any widespread use.

It is previously known from EP-A1-0 575 301 a speed regulator for compressed air operated high speed turbines, which regulator comprise a valve element which is arranged to control the flow of compressed air through the inlet channel as well as a piston means activating said valve element, which piston means is influenced by a speed related control pressure. The control pressure is obtained from an air flow which is led to the idling nozzle and which passes the turbine wheel before it flows to the piston means. The control pressure is determining how much the piston means is able to keep the valve element in an open position against a spring load and how much the air flow to the turbine wheel is throttled. The construction demands narrow tolerances, cooperating pistons provided with sealings, and is farther dependent on the characteristics of the pressure spring. These elements combined leads to a device sensitive to operational disturbances, as well as expensive to produce.

What has been said above has been related to machinery operated using a pressurized gas. In practise air, the expansion of which above a certain pressure fall provides for the work. This can be expressed as the rotation speed multiplied with the torque provided. At a constant addition of airt thus an increased torque will lead to a decreased rotation speed. A corresponding relationship occurs also at engines operated by a liquid, which provides a work by means of a pressure fall in a flow.

The regulating valve according to the present invention can thus be applied at liquid operated engines provided the liquid is not added in a forced controlled volume per time unit. Many hydraulic engines are, however, operated by pumps the flow of which can be adjusted to a constant value and if such a one operates a hydraulic engine of the displacement type an increase of the load of the engine will not lead to a lower rotation speed but instead a higher pressure of the liquid, resulting in a larger resistance in the pump and thereby a larger work provided. At hydraulic engines of the non-displacement type and operation in another way than by means of a displacement pump, for example by means of a liquid under pressure from a pressure accumulator, however, the regulating valve according to the invention may be applicable even within the hydraulic field.

DESCRIPTION OF THE INVENTION

The main principle of the invention is to utilize changes in the flow of fluid through the engine dependent upon its load to control the rotation speed. A load of the engine leading to a lower rotation speed will naturally mean a change of the pressure and the volume passing through. If the rotation speed tends to fall during load this can be counter acted as the changes of the flow through the engine are allowed to influence a valve controlling the flow to the engine. It is this valve that constitutes the invention.

By means of the same one can thus obtain a control of the rotation speed to maintain a substantially constant rotation speed independent of the torque load without any need for a complicated centrifugal regulator or piston arrangement.

The invention is based on the following principle. At least at displacement engines operated by a compressible pressure medium such as air, a constant absolute volume is transferred through the engine for each rotation of the engine, which may be a lamella engine. The term absolute volume means hereby a volume measure which is independent of the pressure. This means that the inlet flow per time unit of pressure medium calculated in absolute volume will directly proportional to the rotation speed of the engine. At a particular channel area in the inlet of the engine this can also be expressed as that the flow rate is proportional to the rotation speed provided that the medium pressure at the point of measure is the same as in the cells of the engine in which cells the medium is transferred from the inlet to the outlet while carrying out the work of the engine.

The larger the driving torque is, which is put on to the engine, the larger must the pressure to the same be. If the rotation speed of the engine is adjusted by means of a valve in the inlet, which is anticipated here, this will mean that at a higher torque load of the engine, the pressure to the engine will, if the valve is kept at a constant opening, increase, which at the constant inlet flow will mean that a smaller absolute volume I added to the engine as the medium has been compressed. Thereby the rotation speed is decreased. If the rotation speed shall be kept constant or shall be able to be regulated independent of the instantaneous torque load this has to be done by regulating the flow inlet of the medium by means of said valve. Hereby the absolute volume through put and thereby the rotation speed of the engine can be regulated.

If the regulation shall be carried out automatically so that the rotation speed as adjusted to a torque added which is the object of the invention this can be done by means of the invention in such a way that the inlet flow to the engine calculated in absolute volume is allowed to control the inlet flow from the source of pressure to the engine.

The invention is thus based on the principle that means for controlling the inlet flow of an absolute volume per time unit is arranged in the inlet of the engine and that these means are connected to a valve device at the inlet for controlling the same, so that the rotation speed can be kept constant independent of the torque added. Alternatively, the regulating system can be arranged in such a way that the rotation speed is changed dependent on the torque added after a predetermined correlation to that for example, the rotation speed is increased at a higher load (in stead of being reduced as happen if no regulation exists). Preferably, the inlet flow is measured in an absolute volume as inflow rate, whereby the control means shall regulate the flow rate independent of the pressure.

DESCRIPTION OF THE DRAWING FIGURES

In the following an embodiment of the regulating valve of invention will be described. The description is thereby related to the use of air operated engines. The description further comprises a more theoretical description of the invention as a principle, as well.

The attached drawing shows

FIG. 1 a diagram Illustrating the principle of the invention; and

FIG. 2 a cross section through a schematic regulating valve of the invention

DESCRIPTION OF A PREFERRED EMBODIMENT

Figure 1:
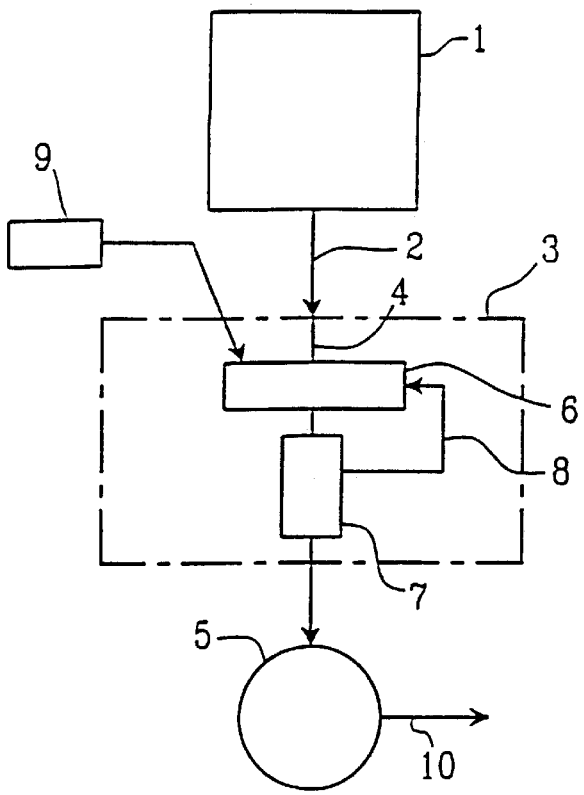

In FIG. 1, 1 denotes a pressure source, e.g. a compressor having a pressure vessel, denotes a feed line to the regulating valve of the invention, which valve is denoted 3, and is shown circumvented by a chain-dotted line. The regulating valve has an inlet line 4 which leads to the engine 5 operated by the pressure medium and which is supposed to be a displacement engine, e.g. a lamella engine of the type present in air operated tools. The pressure medium through the inlet line 4 passes through a throttling valve 6, by means of which the flow through the inlet can be throttled down more or less. After the throttling valve 6 there is a control means 7 inserted into the line 4, which means is arranged to regulate the speed of the air flow through the line 4 dependent on the pressure. A regulating connection 8 from the control means 7 to the valve 6 takes care of the influence of the measured value of the means 7 influences the valve 6 so that a constant flow determined in absolute volume is obtained passing the measuring means and in to the engine 5. Thereby the rotation speed of the engine will remain constant independent of the torque load.

As mentioned above, the regulation may be adjusted to provide a rotation speed controlled by the torque according to a predetermined curve.

Further, it is supposed that the valve 6 can be controlled from a means 9, which, at air operated tools, is manually influenced, but, as an alternative, can be contemplated of being influenced by some other controlling means, as well. In stead of having the means 9 influencing the valve 6 a particular valve for this control can be arranged in the inlet line 4. After having carried out its work in the motor, the medium flows out through an outlet 10.

Figure 2:
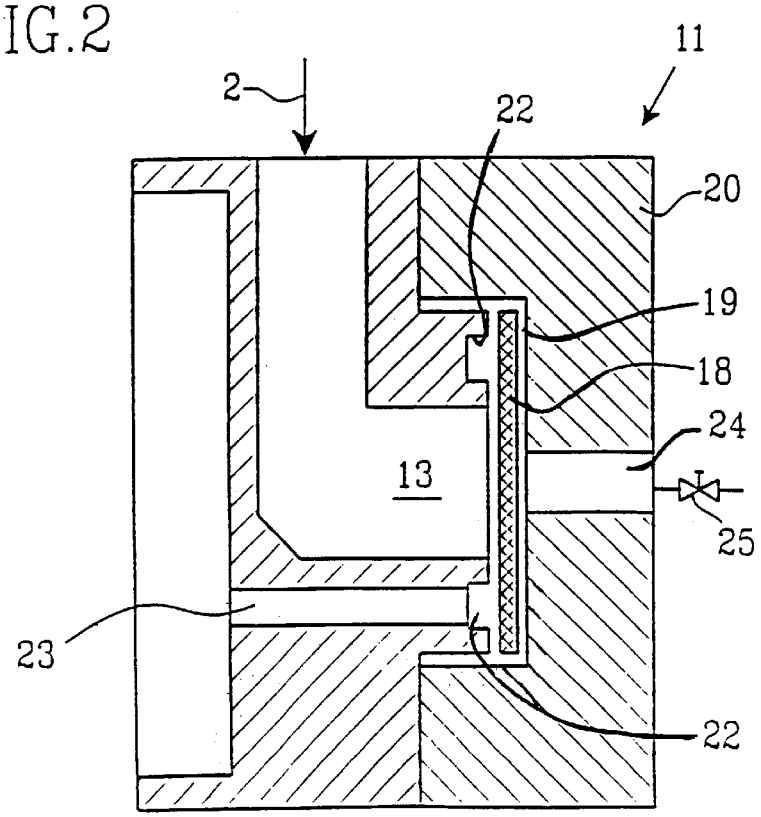

In the following, an embodiment of regulating valve 3 will be described with reference to FIG. 2 which valve is supposed to be connected to compressed air system via a feed line 2. Furthermore, in the feed line to the engine there is a valve for the independent regulation of the rotation speed, e.g., manually. Such a valve is not shown.

From the valve 3 there is a outlet line 23 for the regulated air which outlet line is connected to the inlet of the compressed air of the engine 5. Suitable engines are previously known and can be displacement engines, often lamella engines, such as the turbine engine described in the previously mentioned patent publication of U.S. Pat. No. 5,299,392 (Jacobsson et al).

The regulating valve 3 of the invention is, as mentioned, arranged for throttling the feed air to the engine. In the embodiment it comprises a house 12 having an inlet line 4 for air from a compressed air system which line opens in a recess 19. For the instantaneous regulation of the air flow through the regulating valve a valve body 18 is arranged comprising a plate 18, which lies with a play, both radially and axially in the recess 19. This is formed between the house 12 and a cap 20. The recess is provided with a centrally arranged inlet opening 13 for the air fed, i.e. it is thus directly connected to the compressed air system. The inlet opening 13 of the recess is circumvented by an annular channel 22 being connected to an outlet line 23 from the valve, thus the line from which the regulated amount of air is added to the engine. The inlet opening as well as the channel 22 are situated on the same side of the recess and are thus both situated frontally towards the one flat side of the plate 18 (the left one of the drawing).

From the recess 19 there is arranged a further channel 24 the flow cross area of which can be regulated by means of a screw valve 25.

At the inlet flow through the inlet opening 13 air flows into the recess 19 where the plate 18 is situated. This air distributes around the plate which can be said being influenced by a dynamic pressure on both its sides; air leaches over to its rear side, which is turned from said inlet and outlet channel, as well. This will give the plate a balanced position with a certain distance to the side of the recess where the opening 13 and the channel 22 end. This distance represents the width of a slot through which the air passes from the inlet opening 13 to the annular channel 22 and the outlet line 23. Changes of this slot will provide a changed air flow in the channel connection 12, 19, 23 passing by the valve body which the plate forms.

When the torque against the engine increases the flow and the pressure in the recess 19 to become influenced and hereby a changed pressure balance will influence the plate 18 at the side facing the inlet and outlet channel (left side) relative to the pressure against the rear side of the plate (its right side). Hereby, the plate will move further into the recess 19 (to the right) the slower the flow rate will become in the outlet line 23, which mean that the slot for transferring air from the inlet opening 13 via the recess 19 and to the outlet opening 23 increases and thereby also the flow through the valve and vice verse. Hereby the reduction of rotation speed of the engine is counteracted at an increased load and racing at deloading, respectively.

The idling rotation speed without load will be maintained through the air leaching and passing by the plate 18. This amount and thereby the idling speed can be regulated by means of the valve 25 by means of which the counter pressure on the rear side of the plate can be regulated as different amounts are let out through the channel 24.

In the embodiment the plate 18 functions as a valve. It recognises the air flow through the dynamic relationship on the both sides thereof in the recess 19 and thus adopts to a position determined by regulating need in the recess, so that the area of the flow channel passing by tile plate is changed and thus the air flow to the engine being regulated. The fact that there is no distinct measuring means in the principle FIG. 1 and a valve being regulated by the same does not mean that the principle according this figure is left.

The basic idea of the invention is thus that the change of the flow rate which occurs in a fluid engine in its inlet of the pressure medium at tendencies to changes in the rotation speed at a changed load, is utilized to control a valve for the fluid so that it is opened to allow a larger inflow when said flow rate is reduced, and vice verse. Hereby, the larger amount of work, which is required at larger torque loads on the engine, will be catered for in such an amount that tendencies for rotation speed reduction at increased load at least to some extent will be compensated for. This effect can be utilized at all systems using displacement engines operated by a compressible medium, a gas. At turbine engines and engines using liquids as a operating medium, which are not compressible, the effect can be utilized in such cases which has been mentioned in the beginning above.

The channel 24 mentioned for the flow which shall maintain the idling can be designed in other ways. For example, the flow can be carried out in a shunt passing the regulating valve.

What is claimed is:

1. A regulating valve for pressurized medium compressed air operated engines in order to obtain a substantially constant speed at varying load, the regulating valve being provided with a valve body for controlling the instantaneous volume flow through the regulating valve, wherein said valve body is disc shaped and arranged with a radial and axial play in a recess, the recess is provided with a centrally arranged inlet opening and on the same side an annular channel which circumvents the inlet peripherally and is open towards the recess, which channel is connected to the inlet of the engine; and wherein the recess has such a width that the valve body is movable in the same whereby flowing medium in the recess on the both sides of the valve body by means of flow dynamic forces tends to press the valve body in the direction towards the channels obtaining a closing force which is counteracted by an opening force towards the other side of the valve body by inflowing medium so that, hereby, such a balance is maintained in the position of the body that it, at an increasing pressure of the medium in the channels of the regulating valve, tend to move from the side of the recess where said two channels are situated and increases thereby the through flow area passing by the valve body so that the tendency of the engine to reduce its rotation speed at an increased load is counteracted, and vice verse.

2. A regulating valve according to claim 1, wherein an outlet channel is arranged at the side of the recess facing away from the inlet and the annular channel to provide a leach flow the size of which influences the closing force against the valve body and thereby its regulating position in the recess.

3. A regulating valve according to claim 2, wherein the outlet channel for the leach flow is provided with an adjustable valve by means of which the rotation speed can be regulated at a certain torque load for adjusting the idling speed.

* * * * *